United States Patent [19]

Kimber

[11] 3,993,271

[45] Nov. 23, 1976

[54] DRILL BOOM ARRANGEMENT

[75] Inventor: Erich Voldemar Kimber, Handen, Sweden

[73] Assignee: Atlas Copco Aktiebolag, Nacka, Sweden

[22] Filed: July 3, 1975

[21] Appl. No.: 592,931

[30] Foreign Application Priority Data

July 11, 1974 Sweden ..... 7409106

[52] U.S. Cl. ..... 248/16; 173/43; 248/2

[51] Int. Cl.[2] ..... E21C 9/00; E21C 5/08; E21C 11/00

[58] Field of Search ..... 248/2, 16; 173/43, 147

[56] References Cited

UNITED STATES PATENTS

| | | | |
|---|---|---|---|
| 2,165,404 | 7/1939 | Mitchell | 173/43 X |
| 2,704,203 | 3/1955 | Feucht | 173/147 X |
| 2,718,118 | 9/1955 | Benjamin | 173/147 X |
| 2,819,042 | 1/1958 | Feucht | 173/147 X |
| 3,889,906 | 6/1975 | Kimber | 248/16 X |

*Primary Examiner*—J. Franklin Foss
*Attorney, Agent, or Firm*—Flynn & Frishauf

[57] ABSTRACT

A drill boom arrangement for positioning an elongated rock drilling apparatus to different drilling positions with respect to a support. The rock drilling apparatus is carried by a drill boom and the drill boom is mounted on a boom bracket. The boom bracket is slidable relative to the support in the latitudinal direction of the rock drilling apparatus. The boom bracket is moved along guiding means on the support means of a hydraulic cylinder. Means are provided for gearing up the piston stroke of the hydraulic cylinder.

15 Claims, 6 Drawing Figures

DRILL BOOM ARRANGEMENT

This invention relates to a drill boom arrangement for positioning an elongated rock drilling apparatus to different drilling positions with respect to a support.

The invention is preferably intended to be used in drill rigs for tunnelling and drifting. Drill rigs of that type are provided with one or several hydraulic booms, each of which carries a rock drilling machine. The invention is meant to be complementary to these ordinary drill booms. The object of the invention is to provide a drill boom which makes possible a quick and effective opening up of a cut in a vertical surface.

To this end, the drill boom is movable in its latitudinal direction and is mounted on a drill wagon or drill rig. In such a movable drill boom, it is important that the mechanism for moving the drill boom does not project to a disturbing extent before the sides of the drill rig in order not to deteriorate the capability of the drill rig to be handled and driven forward.

The object of the invention is to provide a drill boom of the above-mentioned type where the need for space at the mounting of the boom bracket to a supporting device, such as a drill rig, can be substantially reduced.

The above and other purposes of the invention will become obvious from the following description and from the accompanying drawings in which two embodiments of the invention are illustrated by way of example. It is to be understood that this embodiment is only illustrative of the invention and that various modifications thereof may be made within the scope of the claims following hereinafter.

Figure 1:
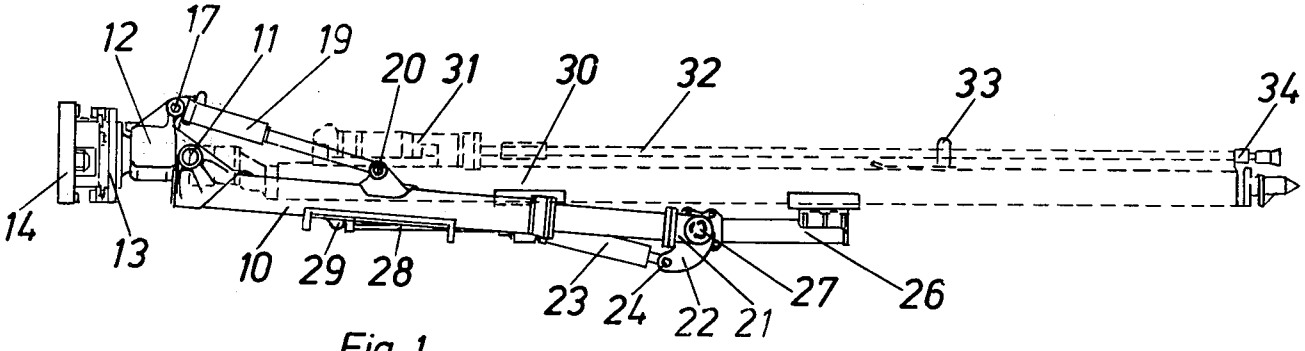
FIG. 1 shows a side view of a device according to the invention.
Figure 2:
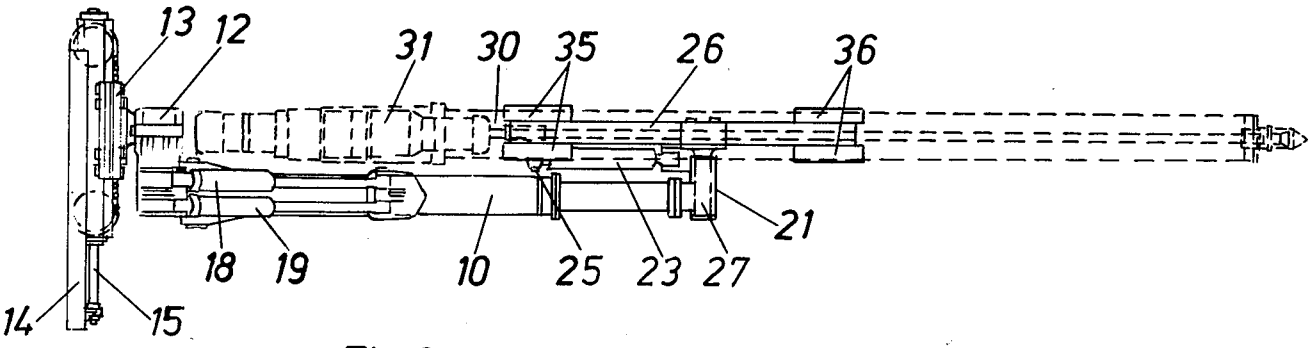
FIG. 2 is a top view of the device in FIG. 1.

In FIGS. 1, 2 a drill boom 10 is carried swingably on a cross shaft 11 which is carried by a boom bracket 12. The boom bracket 12 is mounted on a slide 13. The slide 13 is movable relative to a supporting device 14 by means of a hydraulic cylinder 15. The supporting device 14 forms part of a drill wagon or rig, not shown, on which a plurality of drill booms can be mounted in a group.

The boom bracket 12 is provided with a sleeve, which is secured by wedge to a pivot 16, which forms part of the slide 13. An arm provided with a journalling bushing for the cross shaft 11 extends radially from the sleeve of the boom bracket 12. Journalling lugs projecting from the radial arm carry a shaft 17 parallel with the cross shaft 11. The shaft 17 provides a pivotal connection for a hydraulic elevating cylinder 18 and a hydraulic pilot cylinder 19, which both with the ends of their piston rods are pivotally attached to a shaft 20 on a drill boom 10.

The drill boom 10 carries a boom head 21 which is provided with journalling lugs 22 in which lugs a hydraulic tilt cylinder 23 is pivotally journalled by a shaft 24. The tilt cylinder 23 is pivotally connected to a shaft 25 on a feed holder 26 which is journalled swingably on the boom head 21 by means of a cross shaft 27. The cross shaft 27 is parallel with the cross shaft 11 of the boom bracket 12, which cross shaft 11 carries pivotally the drill boom 10.

A hydraulic feed bar displacing cylinder 28 is fixed to the feed holder 26 and also fixed to a bracket 29 which in its turn is fixed to a feed bar 30. The feed bar 30 supports in conventional manner a rock drilling machine 31 which is mechanically fed to and fro therealong. In the following the feed bar 30 and the rock drilling machine 31 are referred to as an elongated rock drilling apparatus. The rock drilling machine 31 rotates and delivers impacts against a drill steel 32 which is guided by means of drill steel centralizers 33,34 mounted on the feed bar. The feed bar 30 is supported slidably in longitudinal direction on the feed holder 26 by means of guides 35,36 fixed thereon. By extension or contraction of the feed bar displacing cylinder 28 the feed bar 30 is adjusted longitudinally relative to the drill boom 10.

Figure 3:
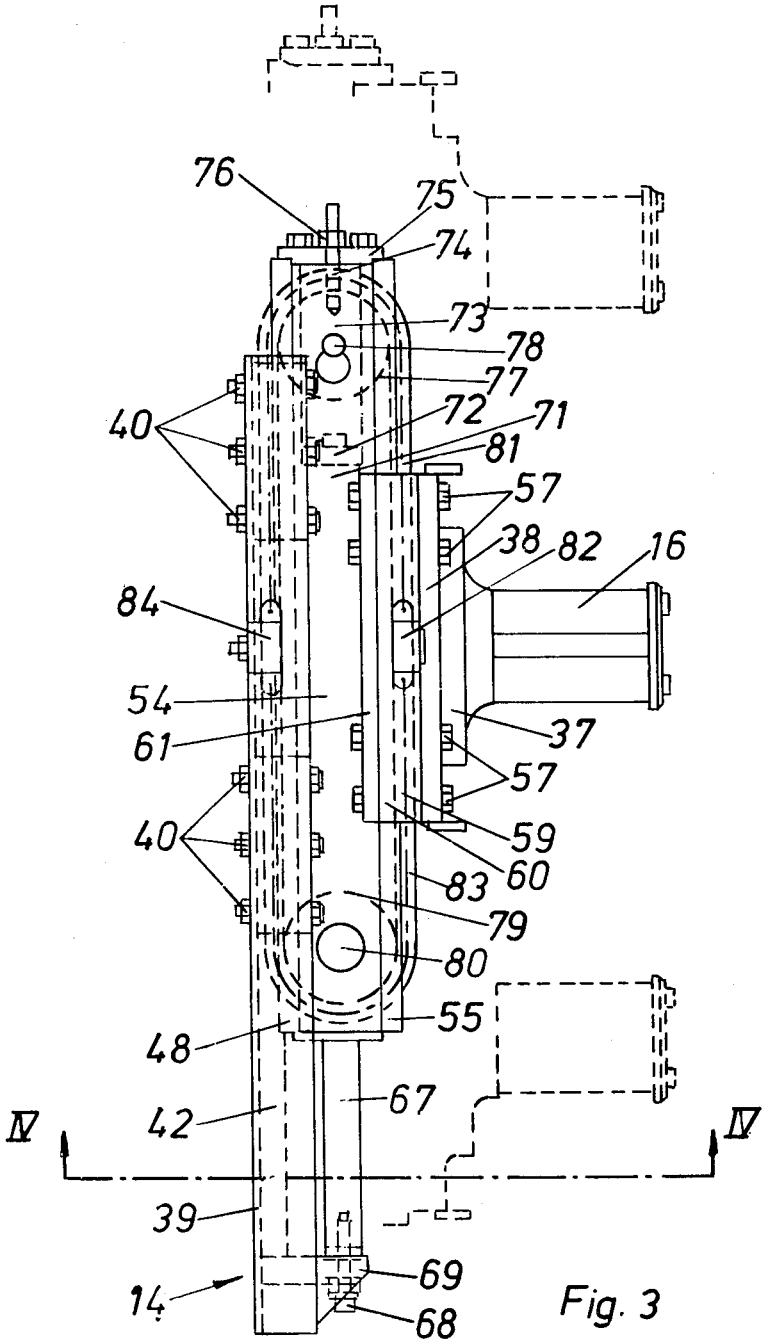
FIG. 3 is an enlarged top view of the mechanism for moving the drill boom in the latitudinal direction.
Figure 4:
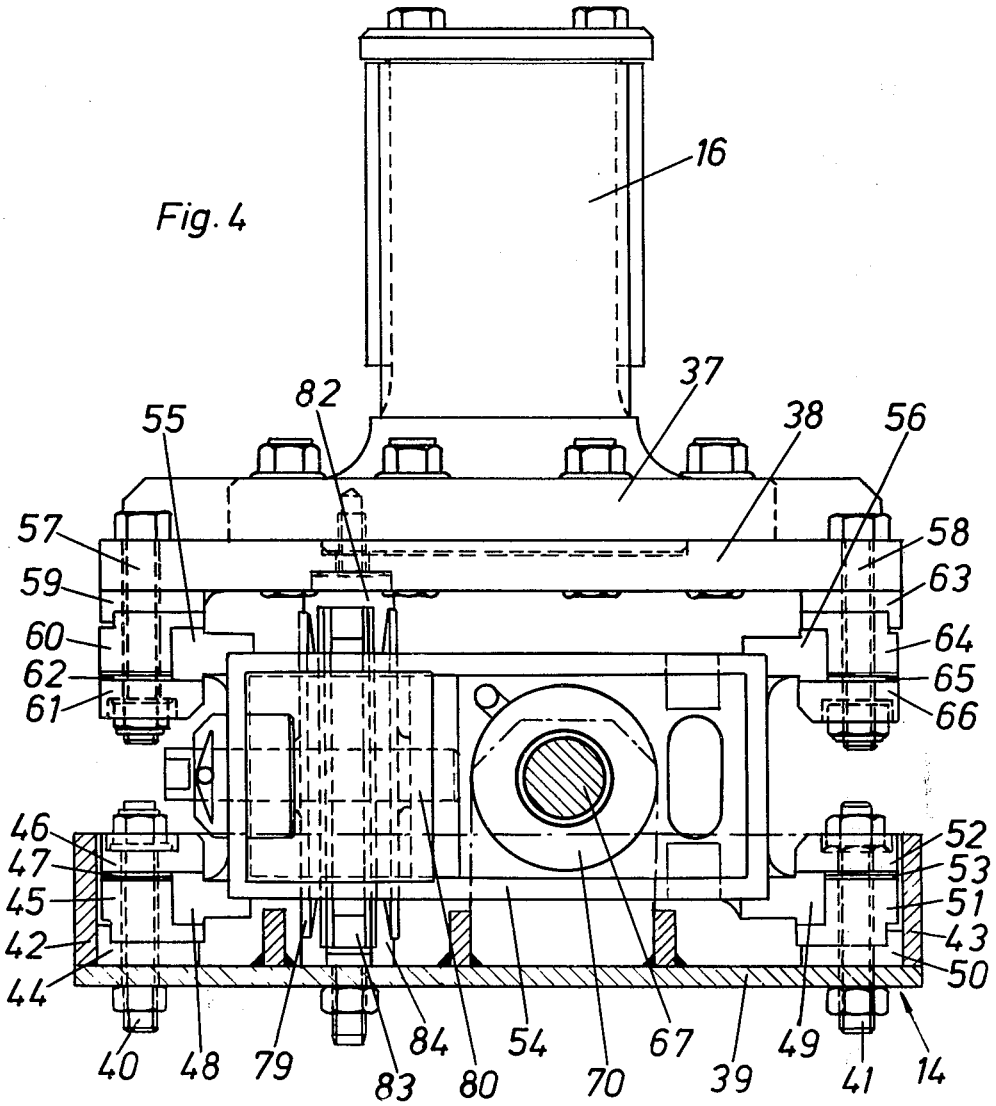
FIG. 4 is an enlarged view, partly in section, taken on the line IV—IV in FIG. 3.

As shown in FIGS. 3, 4 the supporting device 14 comprises a plate 39. The plate 39 is attached to a drill wagon or rig, not shown, by means of bolts 40,41. An upper plate 42, a lower plate 43 and spacing rules 44, 50 are welded to the plate 39. A slide bearing 45 and a bar 46 are attached to the spacing rule 44 by means of the bolts 40. The slide bearing 45 and the bar 46 are provided with sliding and guiding surfaces for a guiding bar 48. For adjustment of the play between the slide bearing 45 and the bar 46, shims 47 are provided therebetween. A slide bearing 51, shims 53 and a bar 52 are attached to the spacing rule 50 in the same manner by means of the bolts 41. The slide bearing 51 and the bar 52 are provided with sliding and guiding surfaces for a guiding bar 49.

The guiding bars 48, 49 are welded to a rectangular case 54. Further, guiding bars 55,56 are welded to the case 54. Spacing rules 59,63 are welded to the plate 38. A slide bearing 60 and a bar 61 are attached to the spacing rule 59 by means of bolts 57. The play between the slide bearing 60 and the bar 61 is adjusted by means of shims 62. The slide bearing 60 and the bar 61 are provided with guiding surfaces for the guiding bar 55. A slide bearing 64, shims 65 and a bar 66 are attached to the spacing rule 63 in the same manner by means of bolts 58.

As shown in FIGS. 3, 4 the pivot 16 of the slide 13 is provided with a flange 37. The flange 37 is screwed to the plate 38.

The piston rod 67 of the hydraulic 15 is attached to a bracket 69 by means of a bolt 68 and the bracket 69 is attached to the supporting device 14. The connection between the piston rod 67 and the bracket 69 is designed in such a manner that a limited angular mobility between said members is made possible.

The cylinder 70 of the hydraulic 15 is mounted within the case 54 between the short side thereof facing the bracket 69 and a cylinder bracket 71 located inside the case. The cylinder 70 is fixed by means of a bolt 72 screwed in the cylinder and secured to the bracket 71.

A chain tightener 73 is guided slidably inside the case 54 in the longitudinal direction thereof. Two bolts 74 are screwed into the wagon 73. The chain tightener 73 can be moved by means of nuts 76 screwed on the bolts 74 and resting against an end gable 75. In the chain tightener 73, a chain wheel 77 is journalled rotatably about a shaft 78. Inside the case 54, also a chain wheel 79 is journalled rotatably about a shaft 80. A chain 81 runs over the chain wheel 77. The one end of the chain 81 is attached to the flange 37 by means of a chain fastener 84. The other end is fixed to the plate 39 by means of a chain fastener 84. A second chain 83 runs over the chain wheel 79. The ends of the chain 83 are fixed to the flange 37 and the plate 39 respectively by means of the chain fasteners 82 and 84. By moving the chain tightener 73, the tension of the chains can be adjusted.

Figure 5:
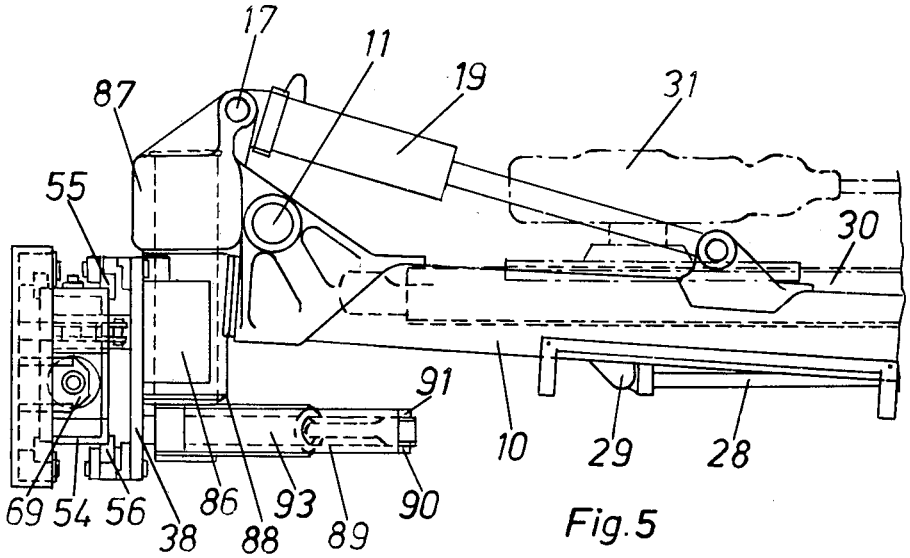
FIG. 5 is a side view of another embodiment of a device according to the invention.
Figure 6:
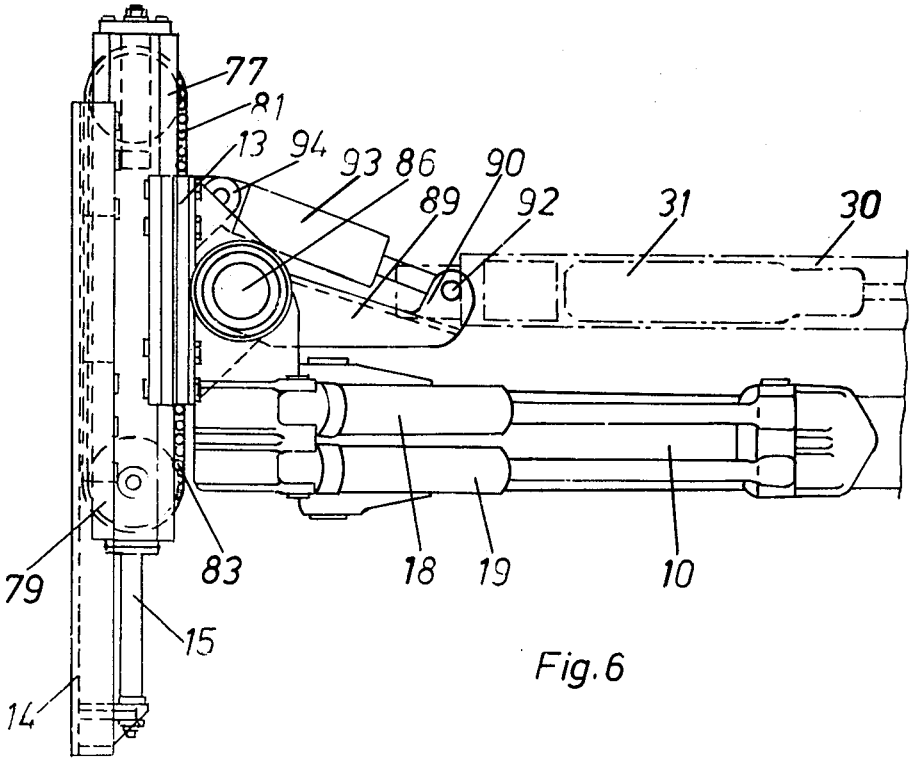
FIG. 6 is a top view of the device in FIG. 5.

In FIGS. 5, 6, another embodiment is shown of a boom bracket in an arrangement according to the present invention. For the sake of simplicity members which are the same as in the embodiment according to FIGS. 1–4 have been given the same reference numerals. A holding member 88 is welded to the plate 38. A shaft 86 is journalled rotatably in the holding member 88. A boom bracket 87 is secured by wedge on the shaft 86. An arm 89 is attached to the shaft 86. Journalling lugs 90, 91 projecting from the arm 89 carry a shaft 92. The shaft 92 provides a pivotal connection for the end of the piston rod of a hydraulic cylinder 93. The cylinder 93 is connected pivotally to journalling lugs 94 projecting from the holding member 88. Besides being movable in latitudinal direction by means of the hydraulic 15, the drill boom 10, thus also can be swung about the shaft 86 by means of the hydraulic cylinder 93.

By extension or contraction of the hydraulic 15, the drill boom 10 can be moved to a desired position of a drill hole. The case 54 and the cylinder 70 are then moved a distance which coincides with the extension or contraction of the hydraulic 15. Due to a construction having the chain wheels 77, 79 and the chains 81, 83, the change of the overall length of the hydraulic 15 is transferred geared up in the ratio 1:2 to the slide 13 which carries the drill boom 10. In FIG. 3, the two extreme positions of the case 54 and the pivot 16 are shown by chain-dotted lines. The distance between these extreme positions, thus, corresponds to the double piston stroke of the hydraulic 15. By designing the movable boom bracket according to the present invention, a great displacement of the drill boom in latitudinal direction is made possible without therefore causing a disturbing great need for space at the boom bracket.

What I claim is:

1. A drill boom arrangement for positioning an elongated rock drilling apparatus (31) to different drilling positions with respect to a support (14) and for drilling blast holes of a cut in the central region of a rock surface to be worked, a drill bit being operatively connected to said rock drilling apparatus (31), comprising in combination therewith:

a drill boom (10), a boom bracket (12), substantially horizontal pivot means (11) on said boom bracket (12) for pivotally journalling one end of said drill boom (10) to said boom bracket (12) so as to permit pivoting of said drill boom (10) in a substantially vertical plane, said one end of said drill boom (10) being the inner end thereof, a boom head (21) carried by said drill boom (10) at the outer end thereof, said rock drilling apparatus (31) being adjustably supported on said boom head (21), and positioning means for positioning said boom bracket (12) and drill bit laterally to both sides of the center of said support (14), said positioning means comprising guiding means (55,56) on said support (14) for slidably supporting said boom bracket (12) relative to said support (14) in the latitudinal direction of said rock drilling apparatus (31), and power means (15,70) for moving said boom bracket (12) along said guiding means (55,56), said power means comprising a hydraulic cylinder-piston assembly, either one of the cooperating cylinder and piston of said assembly being movable relative to said support (14), and transmission means (77,83) operatively interconnecting said power means (15,70) and said boom bracket (12) for gearing up the movement of said one of said cylinder and piston which is movable.

2. An arrangement according to claim 1, wherein said power means (15,70) is located within the lateral extent of the support.

3. An arrangement according to claim 1, comprising at least one pulley wheel (77), said pulley wheel being fixed to the movable one of said cylinder and piston, a flexible element (83), said flexible element being connected to said boom bracket (12) and said support (14), extending therebetween and running over the pulley wheel (77).

4. An arrangement according to claim 3, wherein said piston has a piston rod (15) having a free end which is attached to said support (14), and comprising a guiding frame (54) to which said cylinder (70) is fixed, said guiding frame (54) being movably guided relative to said support (14), and pulley wheels (77,79) mounted to said guiding frame (54) at its ends.

5. An arrangement according to claim 4, wherein said guiding means (55,56; 48,49) of said boom bracket (12) are mounted on said movable guiding frame (54).

6. An arrangement according to claim 5, wherein said guiding frame (54) is boxshaped and said cylinder (70) is confined therein.

7. An arrangement according to claim 1, comprising a cross-shaft (27) adjustably mounting said rock drilling apparatus (31) to said boom head (21), and wherein said boom bracket (12) carries said drill boom (10) on the one side of a swinging plane of said feed bar (30), which swinging plane is perpendicular to said cross shaft (27) and to said pivot means (11).

8. An arrangement according to claim 1, comprising a shaft (86) journalled in said boom bracket (12) and being perpendicular to the direction of movement of said boom bracket (12), means for mounting said drill boom (10) to said shaft (86) such that said drill boom (10) is swingable about said shaft (86), and a hydraulic cylinder (93) coupled pivotally across said shaft (86) and being coupled to said drill boom (10) for swinging said drill boom (10) about said shaft (86).

9. A drill boom arrangement for positioning an elongated rock drilling apparatus (31) to different drilling positions with respect to support (14), comprising in combination therewith:

a drill boom (10), a boom bracket (12) for pivotally carrying said drill boom (10) at the inner end thereof, an elongated rock drilling apparatus (31) adjustably supported on said drill boom (10) at the outer end thereof, a slide (13) for slidably supporting said boom bracket (12) relative to said support (14) in the latitudinal direction of said rock drilling apparatus (31), and a hydraulic cylinder-piston assembly coupled to said slide (13) for moving said slide (13), the cylinder (70) of said cylinder-piston assembly being movable relative to said support (14), and said cylinder (70) being disposed substantially within the opposite protrusions of said slide (13).

10. An arrangement according to claim 9 wherein said piston of said cylinder-piston assembly has a piston rod (15) having a free end which is attached to said support (14), and further comprising:

a guiding frame (54) to which said cylinder (70) is fixed, said guiding frame (54) being movably guided relative to said support (14), at least one pulley wheel (77) mounted to said guiding frame (54), and a flexible element (83) connected to said boom bracket (12) and to said support (14), extending therebetween and running over said pulley wheel (77).

11. An arrangement according to claim 10, comprising at least two pulley wheels (77,79) mounted at respective ends of said guiding frame (54), said flexible element (83) running over said pulley wheels.

12. An arrangement according to claim 9, comprising a shaft (86) journalled in said boom bracket (12) and being perpendicular to the direction of movement of said boom bracket (12), means for mounting said drill boom (10) to said shaft (86) such that said drill boom (10) is swingable about said shaft (86), and a hydraulic cylinder (93) coupled pivotally across said shaft (86) and being coupled to said drill boom (10) for swinging said drill boom (10) about said shaft (86).

13. A drill boom arrangement for positioning an elongated rock drilling apparatus (31) to different drilling positions with respect to a support (14) and for drilling blast holes of a cut in the central region of a rock surface to be worked, comprising in combination therewith:

a drill boom (10), a boom bracket (12), substantially horizontal pivot means (11) on said boom bracket (12) for pivotally journalling one end of said drill boom (10) to said boom bracket (12) so as to permit pivoting of said drill boom (10) in a substantially vertical plane, said one end of said drill boom (10) being the inner end thereof, a boom head (21) carried by said drill boom (10) at the outer end thereof, said rock drilling apparatus (31) being adjustably supported on said boom head (21), guiding means (55,56) on said support (14) for slidably supporting said boom bracket (12) relative to said support (14) in the latitudinal direction of said rock drilling apparatus (31), and power means (15,70) for moving said boom bracket (12) along said guiding means (55,56), said power means comprising a hydraulic cylinder-piston assembly including a cylinder (70) which cooperates with a piston having a rod (15) having a free end, the free end of said piston rod (15) being attached to said support (14), a guiding frame (54) to which said cylinder (70) is fixed, said guiding frame (54) together with said attached cylinder (70) being movably guided as a unit relative to said support (14), and transmission means (77,83) operatively interconnecting said power means (15,70) and said boom bracket (12) for gearing up the movement of said movable cylinder (70).

14. An arrangement according to claim 13 comprising:

at least one pulley wheel (77) mounted to said guiding frame (54), and a flexible element (83) connected to said boom bracket (12) and to said support (14), extending therebetween and running over said pulley wheel (77).

15. An arrangement according to claim 13 comprising at least two pulley wheels (77,79) mounted at respective ends of said guiding frame (54), said flexible element (83) running over said pulley wheels.

* * * * *